US010920387B1

(12) United States Patent
Rivera-Rivera

(10) Patent No.: US 10,920,387 B1
(45) Date of Patent: Feb. 16, 2021

(54) MITER GATE ACTUATOR

(71) Applicant: Luis D. Rivera-Rivera, Fredericksburg, VA (US)

(72) Inventor: Luis D. Rivera-Rivera, Fredericksburg, VA (US)

( * ) Notice: Subject to any disclaimer, the term of this patent is extended or adjusted under 35 U.S.C. 154(b) by 0 days.

(21) Appl. No.: 16/990,904

(22) Filed: Aug. 11, 2020

Related U.S. Application Data

(60) Provisional application No. 62/913,822, filed on Oct. 11, 2019.

(51) Int. Cl.
*E02B 7/40* (2006.01)

(52) U.S. Cl.
CPC ..... *E02B 7/40* (2013.01)

(58) Field of Classification Search
CPC ..... E02B 7/20; E02B 7/40; E02B 7/44; E02B 5/082
See application file for complete search history.

(56) References Cited

U.S. PATENT DOCUMENTS 18,555 A * 11/1857 Seely ..... E02B 7/40 405/99
269,712 A * 12/1882 Renk ..... E02B 7/40 405/99
419,287 A * 1/1890 Scaife ..... E02B 7/44 405/102
1,920,698 A * 8/1933 Huguenin ..... E02B 7/40 137/270
2,750,747 A * 6/1956 Aubert ..... E02B 7/44 405/102
4,073,147 A * 2/1978 Nomura ..... E02B 7/44 405/100
4,352,592 A * 10/1982 Aubert ..... E02B 7/44 405/102
4,735,525 A * 4/1988 Pengelly ..... E02B 13/02 405/99
7,435,035 B2 * 10/2008 Cullen ..... E02B 7/20 405/85
2013/0022402 A1 * 1/2013 Cardis ..... E02B 7/40 405/99

FOREIGN PATENT DOCUMENTS

DE 1145559 B * 3/1963 ..... E02B 7/40
JP 60212510 A * 10/1985 ..... E02B 7/44

* cited by examiner

*Primary Examiner* — Benjamin F Fiorello
(74) *Attorney, Agent, or Firm* — Gerhard W. Thielman

(57) ABSTRACT

An actuator is provided for opening and closing a miter gate. The actuator includes a base, a slider, a yoke, a shaft, a damper and swing arms. The base supports the miter gate as a pair of doors each hinging on respective posts. The base includes a tunnel into which the slider translates. The yoke has a clevis and prongs extending therefrom that pivot on the base and a clevis. The shaft turns in the clevis. The damper has a tube that houses a spring into which a tang inserts. The tang pivots on the shaft within the clevis. The tube pivots on the slider. The first and second swing arms pivotably connect to the slider and to the doors. The doors open by translating the slider towards the doors. The doors close by translating the slider away from the doors.

4 Claims, 8 Drawing Sheets

MITER GATE ACTUATOR

CROSS REFERENCE TO RELATED APPLICATION

Pursuant to 35 U.S.C. § 119, the benefit of priority from provisional application 62/913,822, with a filing date of Oct. 11, 2019, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to actuators. In particular, the invention relates to mechanisms for opening and closing a miter gate, such as with doors having beveled edges.

SUMMARY

Conventional actuators yield disadvantages addressed by various exemplary embodiments of the present invention. In particular, various exemplary embodiments provide an actuator for an actuator for opening and closing a miter gate. The actuator includes a base, a slider, a yoke, a shaft, a damper and swing arms. The base supports the miter gate as a pair of doors each hinging on respective posts. The base includes a tunnel into which the slider translates.

The yoke has a clevis and prongs extending therefrom that pivot on the base and a clevis. The shaft turns in the clevis. The damper has a tube that houses a spring into which a tang inserts. The tang pivots on the shaft within the clevis. The tube pivots on the slider. The first and second swing arms pivotably connect to the slider and to the doors. The doors open by translating the slider towards the doors. The doors close by translating the slider away from the doors.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

Figure 6:
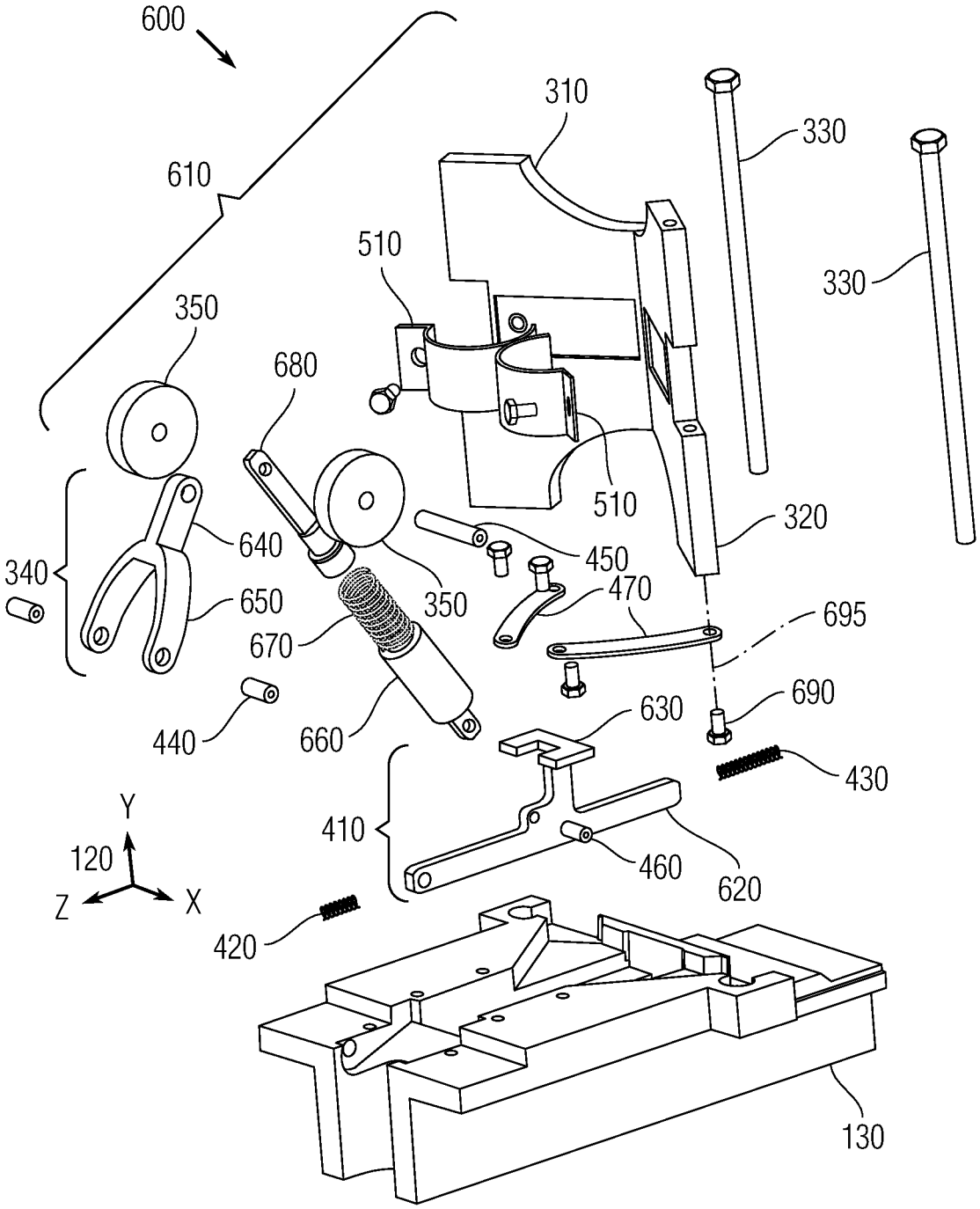
Figure 7:
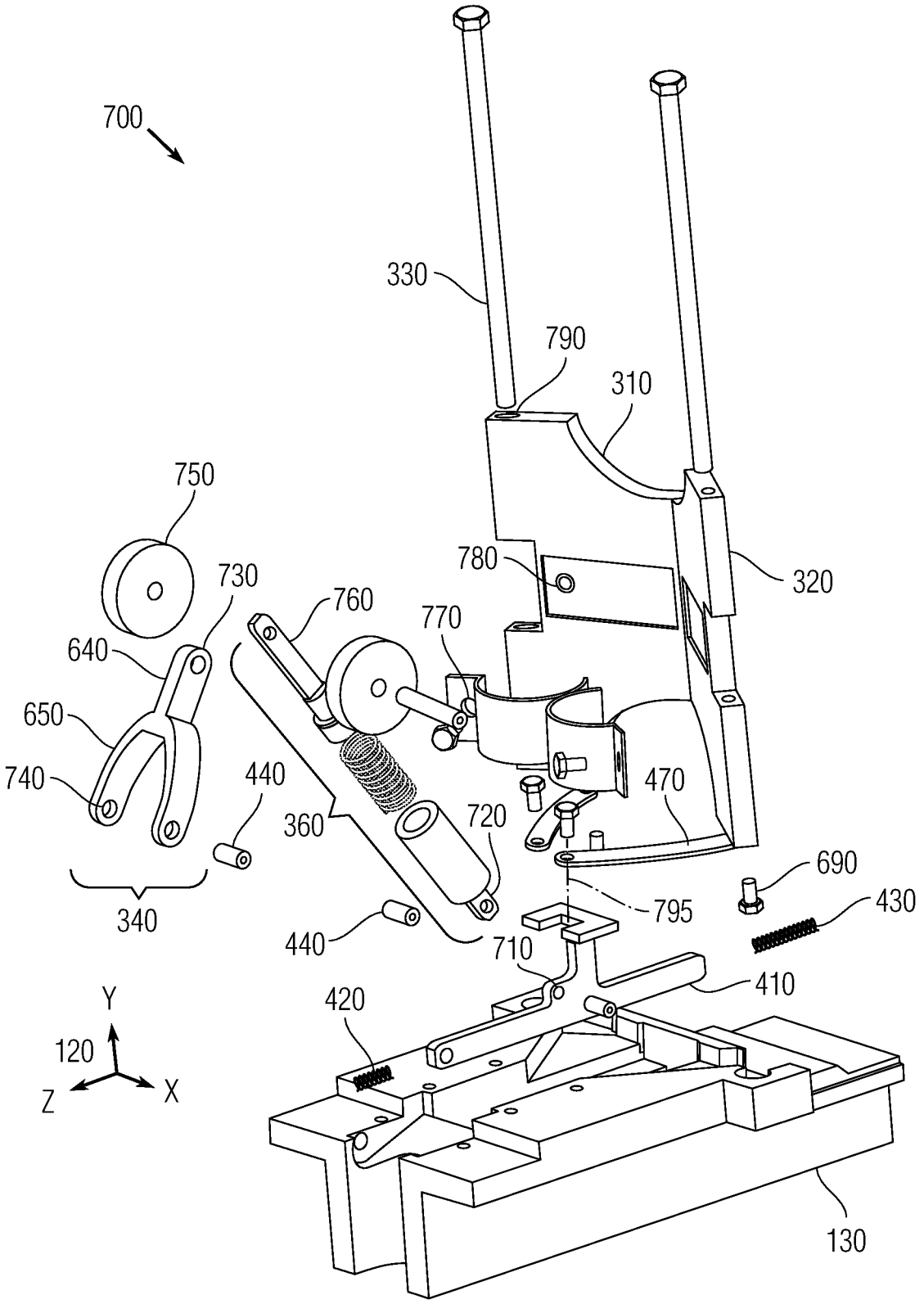
Figure 8:
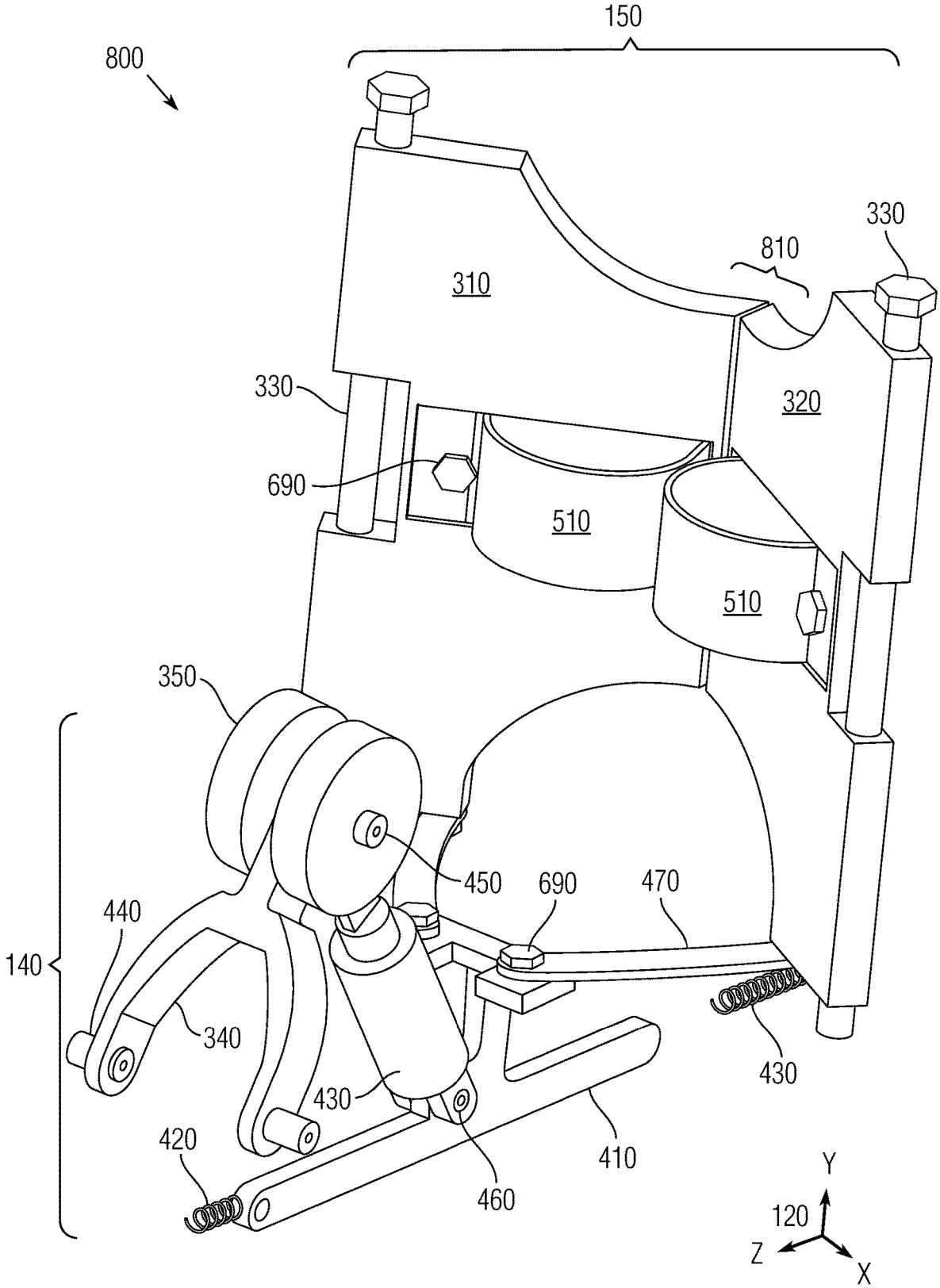

FIGS. A and 5B are respective elevation and plan views of the gate as open;

FIG. 6 is an isometric exploded view of components;

FIG. 7 is an isometric exploded view of the components;

FIG. 8 is an isometric assembly view of the gate as closed; and

Figure 9:
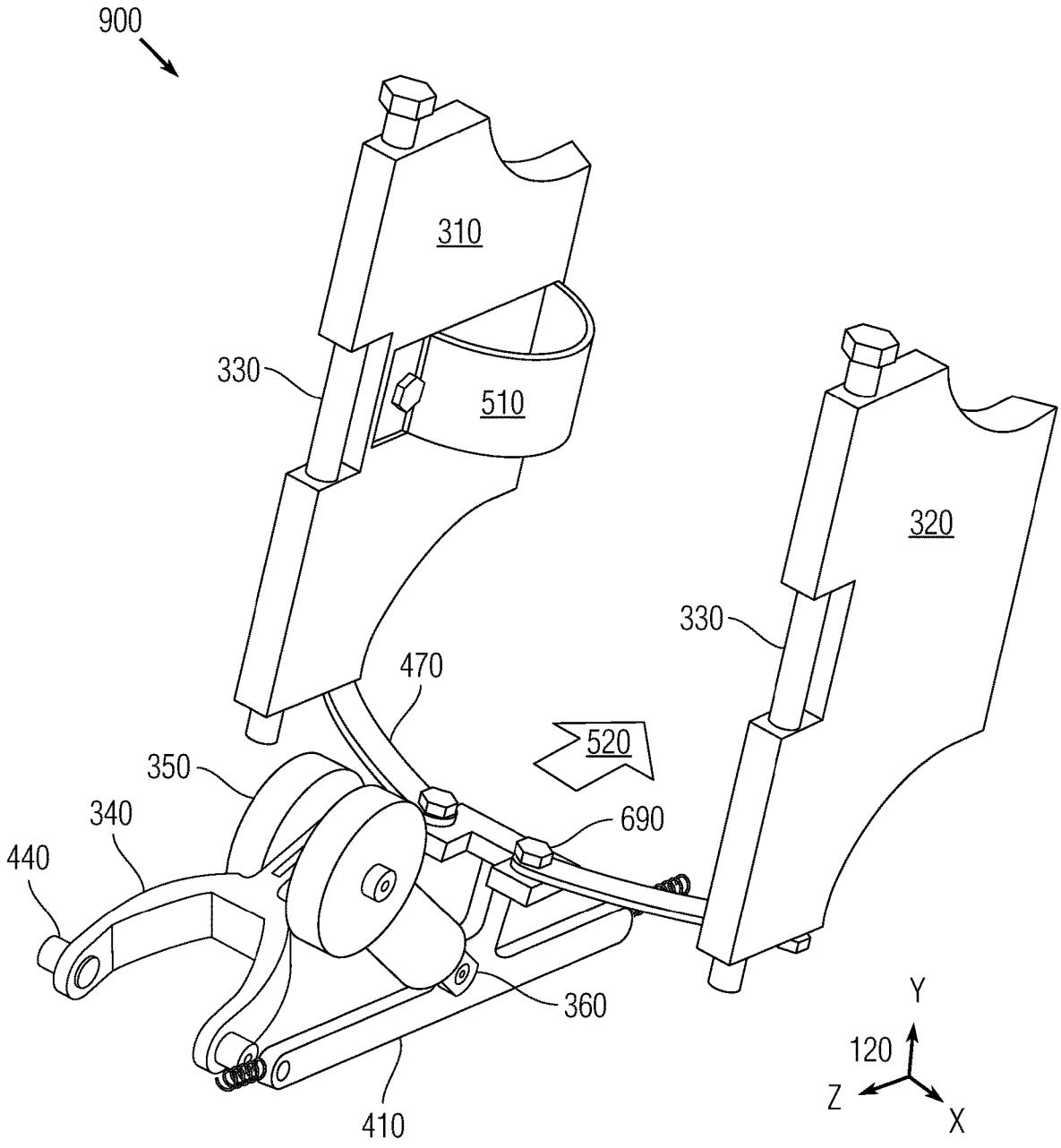

FIG. 9 is an isometric assembly view of gate as open.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in meters (m), mass in grams (g), time in seconds (s), angles in degrees (°), and force in newtons (N). Supplemental measures can be derived from these, such as density in grams-per-cubic-centimeters ($g/cm^3$), moment of inertia in gram-square-centimeters ($kg\text{-}m^2$) and the like.

Figure 1:
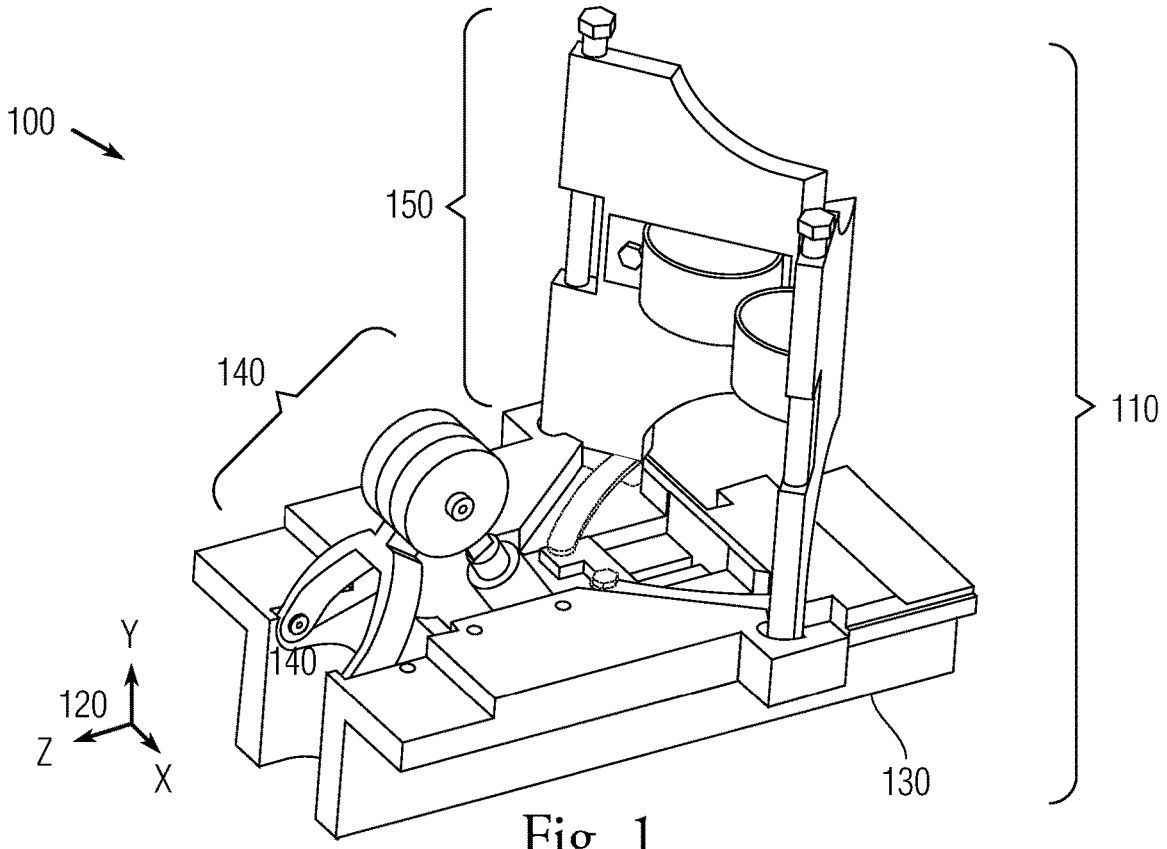
FIG. 1 is an isometric assembly view of an actuator and gate.

FIG. 1 shows an isometric assembly view 100 of a miter gate actuation assembly 110 with a compass rose 120 for orientation with lateral X pointing port, vertical Y pointing upward and longitudinal Z pointing backward or outward. The assembly 110 includes a base 130, an actuator 140 and a gate 150. For purposes of the envisioned utility of exemplary embodiments, the base 130 has an overall length of 0.4 m and a mass of 5.65 kg being machined from aluminum.

Figure 2:
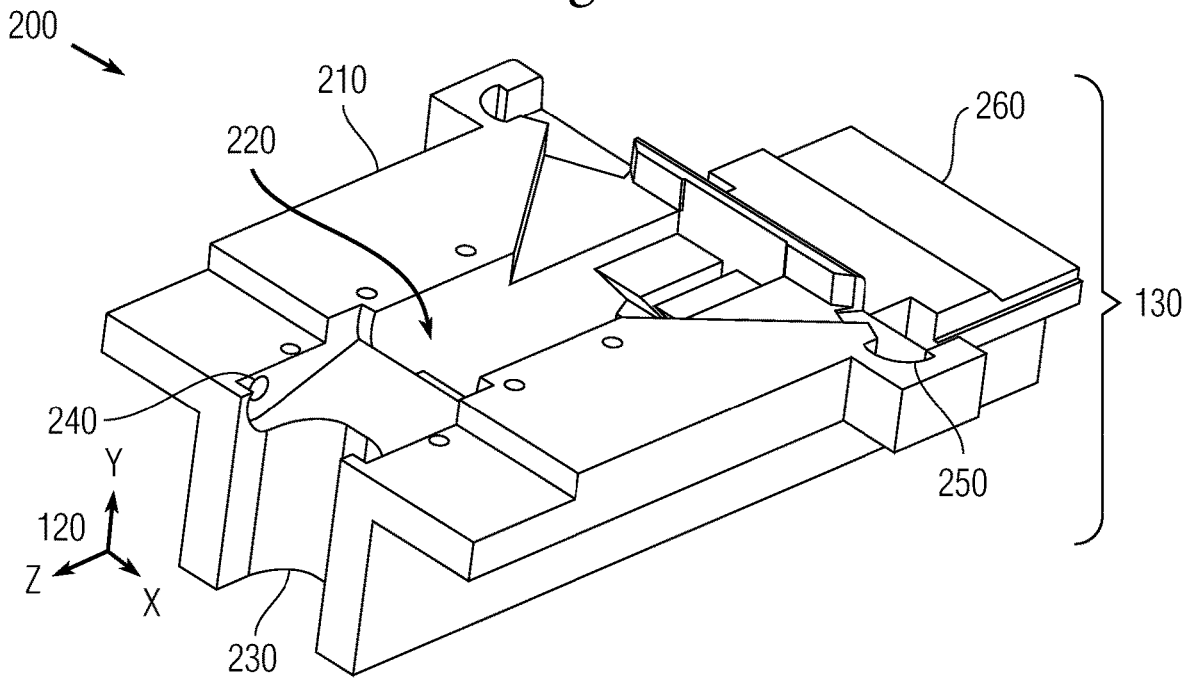
FIG. 2 is an isometric component view of a base.

FIG. 2 shows an isometric integral view 200 of the base 130. An elevated surface provides a horizontal upper platform 210 within which is disposed a center channel 220 that extends longitudinally and vertically. A horseshoe 230 is excavated from the base 130 at the proximal forward end. A pair of lateral orifices 240 flanks the horseshoe 230 for receiving actuator hinges. A pair of vertical cavities 250 from the platform 210 flanks the channel 220 for door posts. A rear platform 260 extends aft from the cavities 250.

Figure 3A:
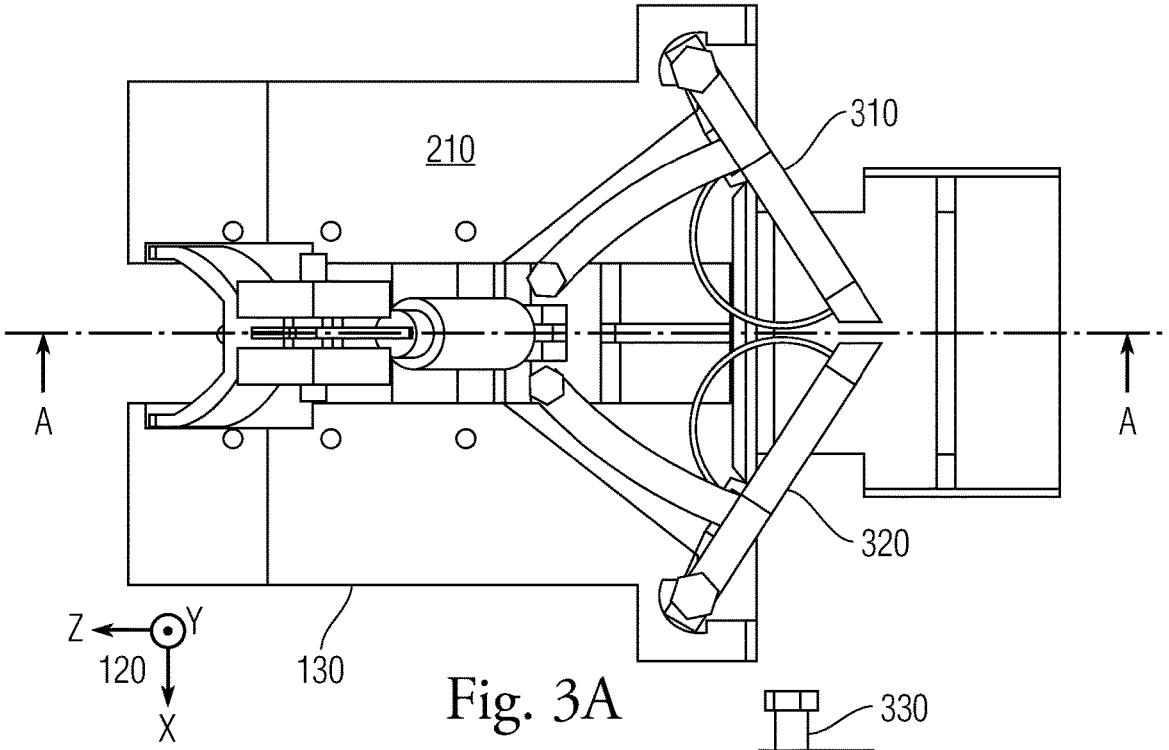
FIG. 3A is a plan assembly view of the actuator and gate.
Figure 3B:
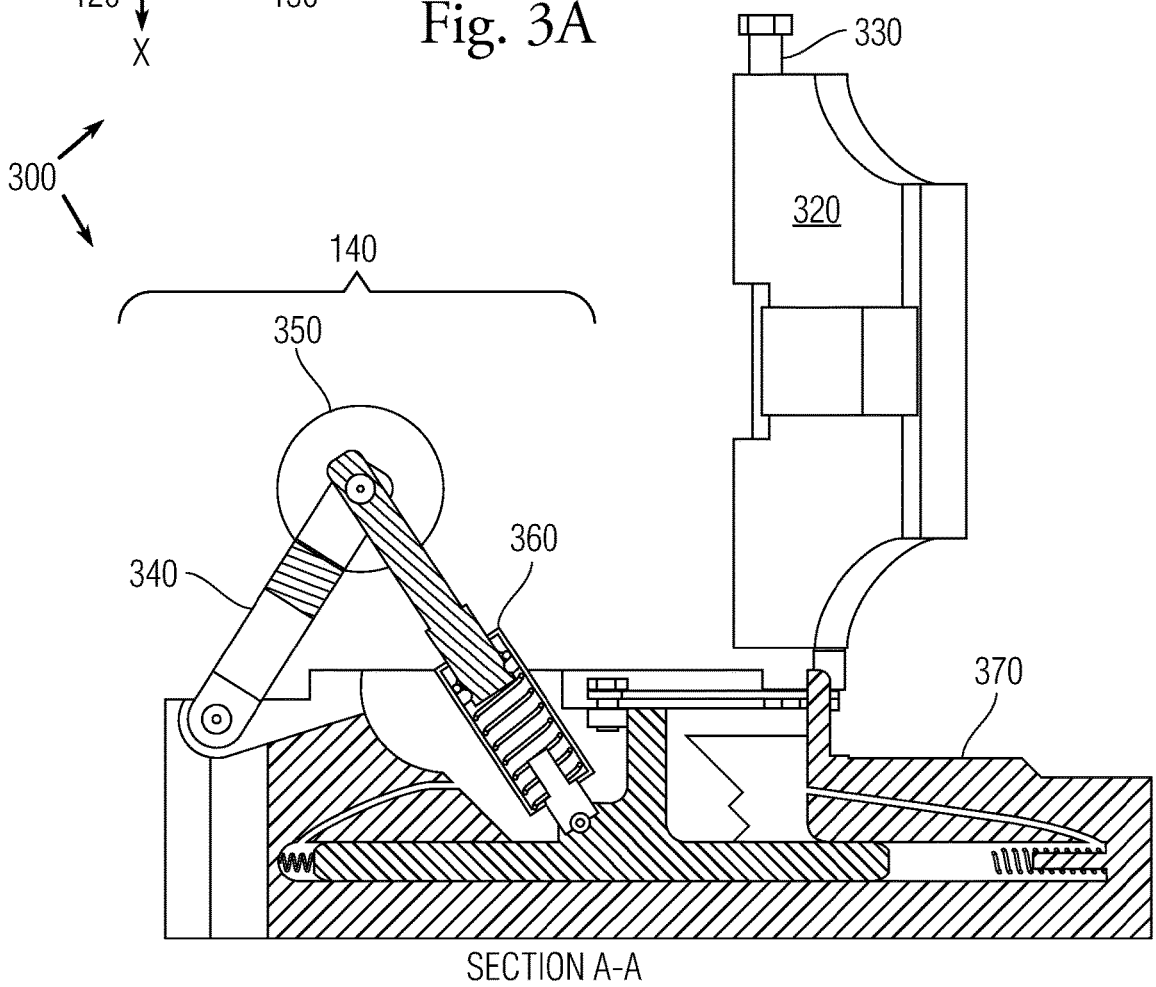
FIG. 3B is an elevation cross-section view of the actuator and gate.

FIGS. 3A and 3B show respective plan (top) and elevation (side) views 300 of the assembly 110. Mid-section along the Z axis of the compass rose 120 in FIG. 3A provides a Section A-A for FIG. 3B as cross-section. The gate 150 (looking forward) includes port door 310 and starboard door 320, each pivoting on a post 330 inserted in the cavities 250.

The edges of the doors 310 and 320 are beveled so as when closed to provide adjoining surfaces that compressively remain closed upon exposure to pressure. The actuator 140 includes a U-shape linkage yoke 340, a pair of wheels 350 and a shock absorber or damper 360. The base 130 includes a tunnel 370 under the channel 220.

Figure 4B:
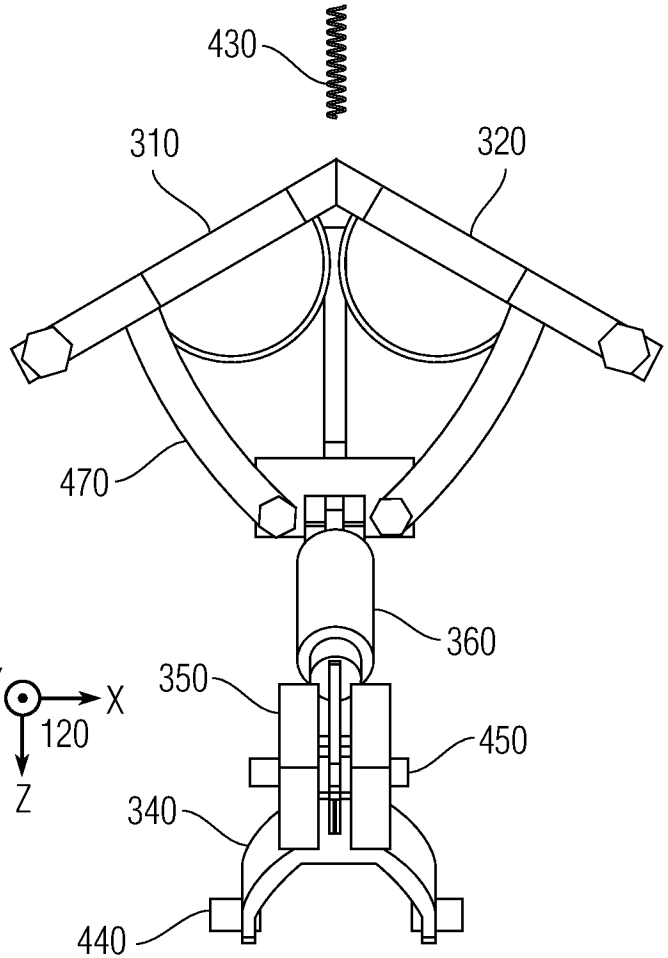
FIGS. 4A and 4B are respective elevation and plan views of the gate as closed.
Figure 4A:
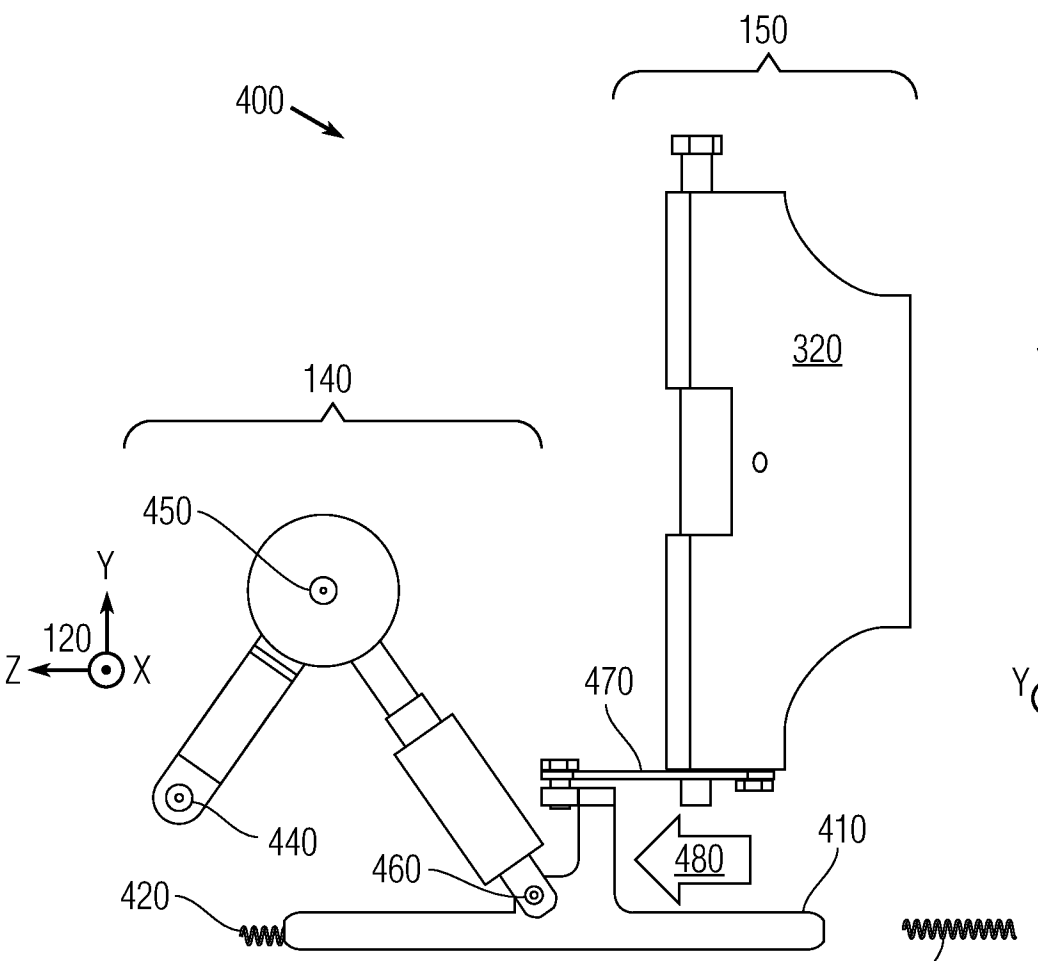

FIGS. 4A and 4B show respective elevation and plan views 400 of the assembly 110 with doors 310 and 320 as closed. A slider 410 translates within the tunnel 370 in the base 130, secured in tension by aft spring 420 and restricted in compression by fore spring 430. Both helical springs 420 and 430 are disposed within the tunnel 370. The actuator 140 further includes a set of pins 440 to pivotably attach the yoke 340 to the base 130 at the orifices 240 that flank the channel 220.

The yoke 340, wheels 350 and the damper 360 join together along an axle or pivot shaft 450. The damper 360 pivotably attaches to slider 410 at a hinge 460. Swing arms 470 connect the slider 410 to the doors 310 and 320. The starting equilibrium position denotes the doors 310 and 320 as fully closed and the slider 410 being held back. To maintain the doors 310 and 320 in the closed position, the aft spring 420 pulls the slider 410 backward by the arrow direction 480, causing the arms 470 to retract inward.

Figure 5B:
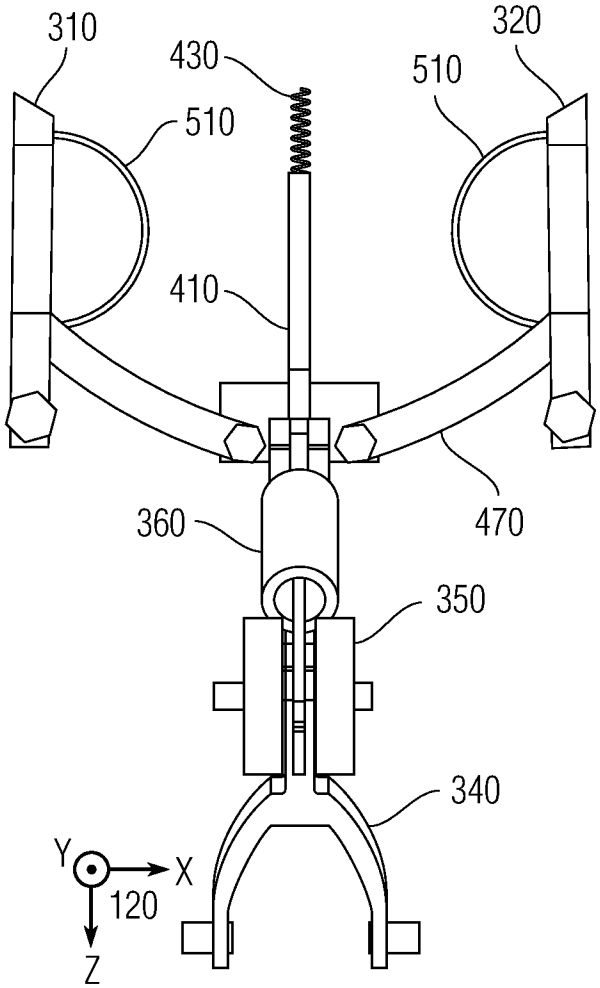
Figure 5A:
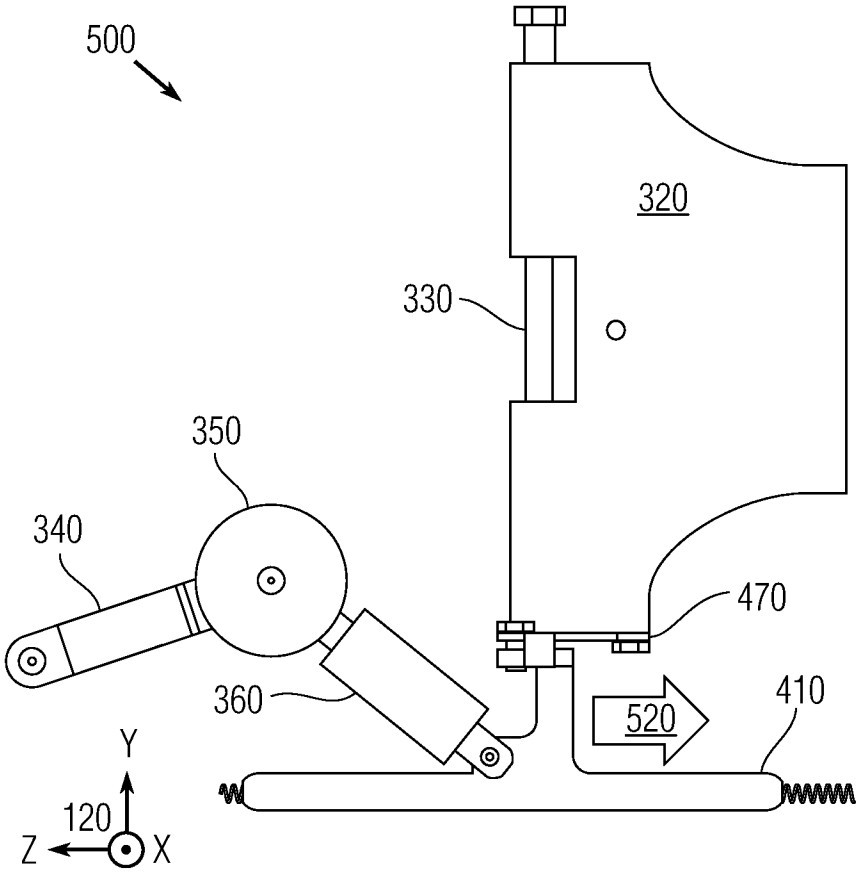

FIGS. 5A and 5B show respective elevation and plan views 500 of the assembly 110 with doors 310 and 320 as open forward and outward. Semi-circular hoop collars called bumpers 510 on the doors 310 and 320 inhibit aft pressure from forcing the gate 150 open. In the event that the slider 410 or the actuator 140 fails, the bumpers 510 absorb impacts against the doors 310 and 320 by preventing any projectile from striking either door directly. In the open configuration, the damper 360 is withdrawn and the yoke 340 depressed pivoting on the pins 440 and shaft 450, causing the arms 470 to splay outward. This causes the slider 410 to move forward by arrow direction 520.

In the open configuration, the wheels 350 on the shaft 450 are pressed downward, and the damper 360 also connected to the shaft 450 is compressed. The yoke 340 rotates on pins 440, and being connected to the shaft 450, controls the movement of the wheels 350 and the damper 360. Connected to the pin 460, the damper 360 pushes the slider 410 forward, causing the arms 470 to extend outward, FIG. 6 shows an isometric exploded view 600 of miter gate components 310 for the actuator 140 and gate 150. The slider 410 includes a flange 620 and an anchor 630. The yoke 340 includes a clevis 640 that connect to fork prongs 650. The extension 350 includes a hollow tube 660, a helical spring 670 and a tang 680. The spring 670 inserts into the tube 660, which connects to the slider 410 by the hinge 460, while the tang 680 nestles inside the spring 670. The tang 680 pitches via the pivot shaft 450. Fastener screws 690 attach the arms 470 to the doors 310 and 320, such as along alignment line 695.

The actuator 140 attaches to the slider 410 with flange 620 and anchor 630 by the hinge 460. The actuator 140 moves the swing arms 470. The pair of opposing bumpers 510 attach respectively to the distal port door 310 and proximal starboard door 320, The doors 310 and 320 pivot on the base 130 by the vertical posts 330 that insert into their respective cavities 250. The wheels 350 can be composed of rubber. The yoke 340, tube 660, tang 680, slider 410 and arms 470 are typically composed of aluminum. The bumpers 510 are composed of steel. The doors 310 and 320 are composed of aluminum with a thermally resistive coating.

FIG. 7 shows an isometric exploded view 700 of the miter gate and actuation components. The yoke 340 comprises the clevis 640 with a through hole 730. Fork prongs 650 extend from the clevis 640, each terminating with a pin hole 740 into which the yoke pins 440 insert for connecting to the base 130 at the orifices 240. The actuator 360 comprises of the tube 660, spring 670 and tang 680, and includes a tang hole 760 at external end of tang 680. Yoke pins 440 insert into the holes 740 for insertion into the orifices 240 in the base 130.

Each wheel 350 has an axis hole 750, and the pivot shaft 450 passes commonly through these axis holes 750 as well as the clevis holes 730 and tang hole 760. The slider 410 is held in tension with the base 130 by the proximal aft helical spring 420. The distal fore helical spring 430 acts to reduce velocity of the slider 410 in the tunnel 370 and prevent actuator components from colliding with casing channel walls. Screws 690 connect the anchor 630 to the arms 470, such as along alignment line 795. These screws 690 or threaded bolts represent helical fasteners, typically with hex heads to facilitate torqueing.

The tube 660 terminates pivot hole 460 at closed end of tube 660 for attaching to the flange 620 by the hinge 460. Fastener screws 690 insert into holes 770 of the bumpers 510. Vertical holes 490 extend one through each door 310 and 320 into which the posts 330 can be inserted for positioning into the cavities 250. Screws 690 extend through the holes 770 of the bumpers 510 for attaching to the doors 310 and 320 through holes 780. Additional screws 690 attach the arms 470 to the anchor 630, such as along alignment line 795.

FIG. 8 shows an isometric assembly view 800 of the miter gate actuation assembly 110 in the close position (with the base 130 omitted). Miter gate bevel tips 810 are shown to abut together as the gate 150—with the actuator 140 and arms 470 in retraction mode. The bumpers 510 abut against each other to reinforce the tips 810 from aft forces that would otherwise push the doors 310 and 320 open.

FIG. 9 shows an isometric assembly view 900 of the miter gate actuation assembly 110 in the open position (with base 130 not shown). Doors 310 and 320 shown swung apart as actuator 150 in extension mode with the slider 410 moved forward as shown by arrow direction 520 to splay the arms 470 outward.

Exemplary embodiments prevent blowback debris from damaging a railgun magazine, autoloader and related components. These embodiments isolate and constrain the debris from the inside of the gun at the aft portion. Also, flow can be re-directed through bridge holes. Any gun launch can release a wide scale of energetics levels, which can be directed at the doors 310 and 320. These levels can range from almost non-existent to violent exothermic near-detonation events, some of which experience exothermic reaction at the breech. In this event, molten metal expels out of the railgun barrel all directions. Such events can cause severe damage.

Possible damage depends of the intensity of the blowback—these can be lead to system damages, collateral fire, thermal damages, system inefficiencies, and or improper operations, Such an event is haphazard and unpredictable. Exemplary embodiments provide a projectile actuator 140 connected mechanically to a pair of doors 310 and 320 of the gate 150.

As the wheels 350 are depressed during loading, the actuator 140 pushes the linkage arms 470 that open the gate 150, A countervailing force pushes the actuator 140, so that the gate 150 remains open. The exemplary mechanism keeps the gate 150 open throughout any operation in which the projectile and its rammer are inside or passing through. After the rammer for the railgun retracts from the gate 150, the actuator 140 and doors 310 and 320 return to the original position, closing the gate 150.

The exemplary gate assembly 110 prevents debris from entering into the autoloader and magazine area. The gate 150 remains closed until a new projectile contacts the actuator 140 during the loading process of a projectile (not shown) via a rammer (also not shown). The actuator 140 includes two rubber shock absorber wheels 350 that resist the projectile's impact. These wheels 350 attach to the U-shape yoke 340 and the damper 360 that serves as a linear dashpot. The yoke 340 attaches to the mechanism base 130 by the pins 440, permitting the wheels 350 move back and forth in circular motion.

The damper 360 attaches to the slider 410, which translates forward to push two linkages as arms 470 and thereby the doors 310 and 320 into the open position. The slider 410 is constrained sideways in the tunnel 370 and remains attached into the aft spring 420 in the rear of the base 130. The aft spring 420 and damper 360 return the slider 410 rearward after the rammer and projectile exit the gate 150. The detached fore spring 430 in front of the slider 410 operates as a stopper to reduce velocity and prevent components from colliding with the casing channel walls.

With the projectile impact downward, the wheels 350 push the damper 360 forward. The damper 360 has greater stiffness than the other two springs 420 and 430. For this reason, the two springs 420 and 430 deform before the damper 360 deforms. This ensures the gate 150 opens quickly as the projectile strikes the wheels 350.

The doors 310 and 320 have two bumpers 510 at the front to serve as shields, They prevents any projectile collision with the gate 150 and ensures that the doors 310 and 320 remain open during the entire interval that the projectile or rammer is inside the gate 150. The doors 310 and 320 are assembled into the miter gate 150.

This configuration supports larger pressure loads without any stopper inside the gate 150. Also, this transfers the load to the hinge 460 and screws 490, and prevents the doors 310 and 320 from closing inward. During launch, debris that can translate towards the gun, does not pass to the magazine or autoloader area. This debris can be re-directed to escape by the existing breathing holes of the bridge.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An actuator for opening and closing a miter gate, said actuator comprising:

a base for supporting the miter gate as a pair of doors each hinging on respective posts, said base having a tunnel;

a slider that translates in said tunnel;

a yoke having a clevis with prongs extending therefrom that pivot on said base;

a shaft that turns in said clevis;

a damper having a tube that houses a spring into which a tang inserts, said tang pivots on said shaft within said clevis and said tube pivots on said slider; and first and second swing arms that pivotably connect to said slider and to respective said doors, wherein said doors open by translating said slider towards said doors, and said doors close by translating said slider away from said doors.

2. The actuator according to claim 1, further including a pair of wheels that flank said clevis, wherein said wheels pivot on said shaft.

3. The actuator according to claim 1, wherein said doors further includes collars to inhibit swinging towards said damper.

4. The actuator according to claim 1, wherein said slider connects at opposite ends in tension to said base by springs.

* * * * *